United States Patent [19]

Lohnherr

[11] Patent Number: 4,919,341

[45] Date of Patent: Apr. 24, 1990

[54] GRINDING METHOD AND GRINDING APPARATUS

[75] Inventor: Ludger Lohnherr, Oelde-Sünninghausen, Fed. Rep. of Germany

[73] Assignee: Krupp Polysius AG, Fed. Rep. of Germany

[21] Appl. No.: 289,059

[22] Filed: Dec. 23, 1988

[30] Foreign Application Priority Data

Jan. 18, 1988 [DE] Fed. Rep. of Germany ..... 3801229

[51] Int. Cl.[5] ..... B02C 23/12

[52] U.S. Cl. ..... 241/18; 241/24; 241/52; 241/57; 241/80; 241/110

[58] Field of Search ..... 241/18, 24, 52, 57, 241/60, 79, 79.1, 80, 110, 117–122, 61

[56] References Cited

U.S. PATENT DOCUMENTS

| | | | |
|---|---|---|---|
| 3,951,347 | 4/1976 | Tiggsbaumker et al. | 241/52 |
| 4,084,754 | 4/1978 | Brundiek | 241/52 |
| 4,109,871 | 8/1978 | Lohnherr | 241/80 X |
| 4,504,018 | 3/1985 | Diggins | 241/79.1 X |
| 4,597,537 | 7/1956 | Misaka et al. | 241/79.1 |
| 4,752,037 | 6/1988 | Farris et al. | 241/79.1 |

*Primary Examiner*—Timothy V. Eley

*Attorney, Agent, or Firm*—Learman & McCulloch

[57] ABSTRACT

The invention relates to a grinding method and to grinding apparatus using a ring mill, in which the air speed in an air ring surrounding the grinding track is chosen to be sufficiently low that a proportion of the material which has already been comminuted to the fineness of the finished product also falls downwards against the air stream and through the air ring, is mechanically elevated and subjected to separation, the resulting tailings being delivered back to the grinding track of the ring mill. Such a solution is distinguished by a substantially reduced pressure loss and accordingly a considerable saving of energy.

10 Claims, 1 Drawing Sheet

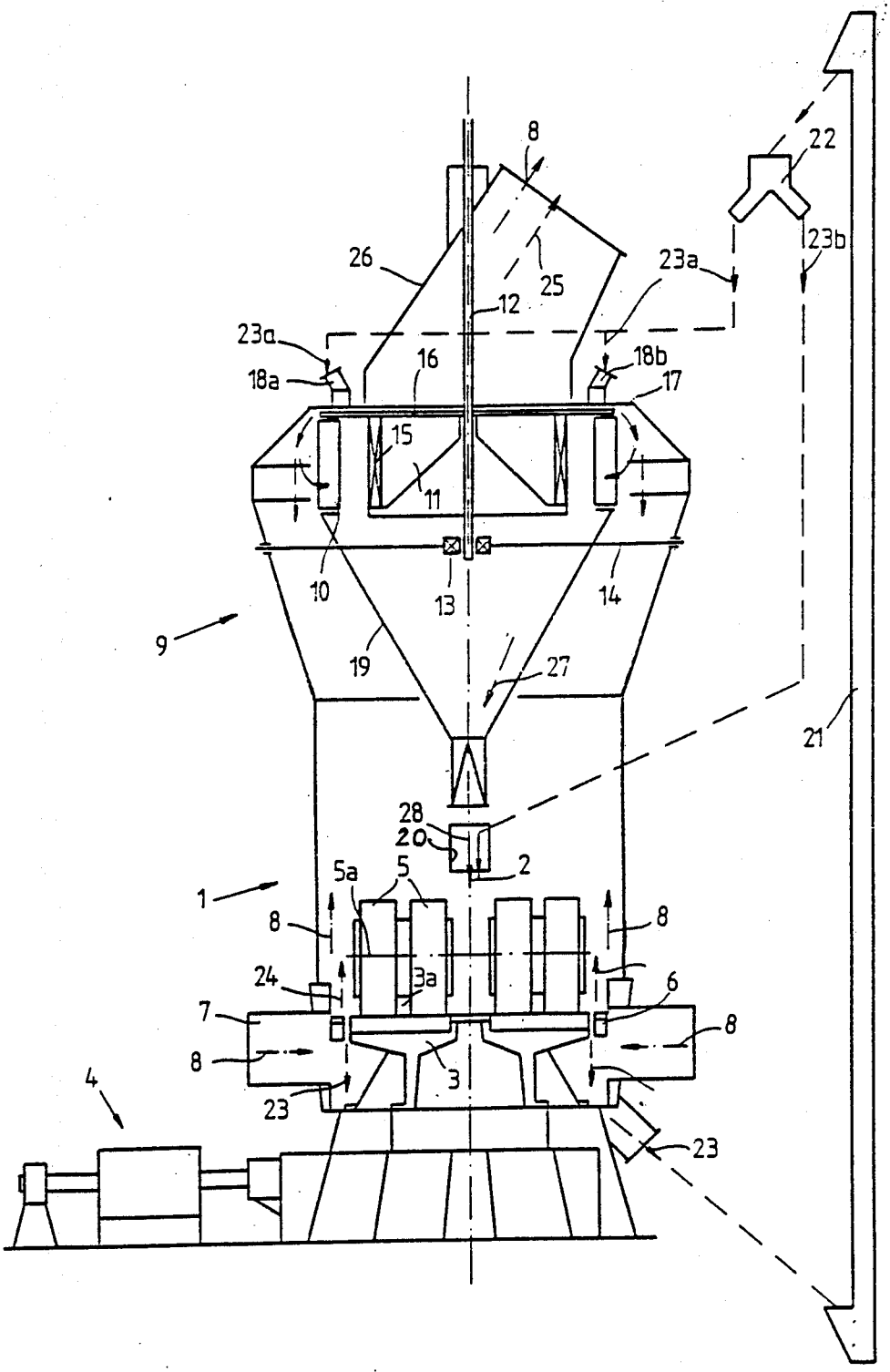
8
22
23b
26
25
23a
12
23a
16
18b
18a
17
15
11
10
13
14
9
19
27
21
28
20
2
5a
5
1
8
8
24
3a
6
7
8
8
3
4
23
23

GRINDING METHOD AND GRINDING APPARATUS

The invention relates to a grinding method and grinding apparatus involving improved air stream utilization providing reduced pressure loss and substantial energy savings.

BACKGROUND OF THE INVENTION

Ring mills are known particularly in the form of bowl roll mills, roller mills or ring-ball mills. In these the grinding elements which are constructed as rolls, rollers or balls roll on an annular grinding plate, and the grinding pressure is produced by spring tension, hydraulic cylinder, centrifugal force or by the dead weight of the grinding elements.

In such mills an air stream is delivered through an air ring arranged stationary on the outer periphery of the grinding plate, and this air stream takes up the fine components of the comminuted material for grinding which is discharged over the edge of the grinding plate and carries these fine particles upwards, whilst the coarse components fall downwards through the air ring against the air stream and are delivered for example by a mechanical elevator back to the mill.

In the previously known grinding method the air speed is set sufficiently high in the nozzle ring that substantially all of the material which is comminuted to the fineness of the finished product and discharged over the edge of the grinding plate is taken up by the air stream and elevated pneumatically to the separator.

A disadvantage with this known method is the high pressure loss associated with the pneumatic conveying of the fines which necessitates the installation of a considerable fan output and involves substantial energy consumption in operation.

The object of the invention, therefore, is to provide an improved and wherein the pressure loss associated with the pneumatic conveying is reduced so that the necessary fan output is reduced and the energy consumption is lower.

SUMMARY OF THE INVENTION

The invention is based on the knowledge, confirmed by extensive tests, that a significant reduction in the pressure loss and consequently a substantial reduction in the fan output to be installed and a considerable lowering of the energy consumption can be achieved if the air speed in the air ring is chosen so that it is so low that a proportion of the material already reduced to the fineness of the finished product falls downwards through the air ring against the air stream and is mechanically elevated, the material elevated by the mechanical conveyor being subjected to separation and the remaining tailings being delivered back to the grinding track of the ring mill.

The mechanically elevated material is advantageously separated with the aid of the same air stream by which a proportion of the material discharged over the edge of the grinding track is carried upwards.

The separation of the mechanically elevated material is advantageously carried out at the same time in the separation zone in which the material carried upwards by the air stream is separated. In this way the separator which is in any case necessary for separating the pneumatically elevated material is also used at the same time for separating the mechanically elevated material, which leads to a saving of costs on the apparatus.

THE DRAWING

One embodiment of grinding apparatus for carrying out the grinding method according to the invention is illustrated schematically in the drawing.

DETAILED DESCRIPTION

The illustrated grinding apparatus contains a ring mill 1 containing a grinding plate 3 which rotates about a vertical axis 2 and is driven from below by a drive 4. Grinding rollers 5 which rotate about horizontal axes **5*a* and are pressed onto the grinding track 3*a* by a mounting which is not shown in greater detail are supported on the grinding track 3*a* of the grinding plate 3**.

The grinding plate 3 of the ring mill 1 is surrounded by an air ring 6 which serves for delivery of an air stream which is delivered via a connection 7 and is illustrated by the arrows 8. The width of the air ring 6 and thus the air speed in the air ring 6 can be set by adjustment of the air ring 6.

A dynamic separator 9 containing a stationary guide vane ring 10 is arranged above the ring mill 1. A rotor 11 which is rotatable about a vertical axis and driven by a drive motor (not illustrated) via a shaft 12 is arranged inside the guide vane ring 10. The shaft 12 is mounted at the lower end in a bearing 13 which is adjustable by means of struts 14 in the radial direction.

The rotor 11 has on its periphery a plurality of adjustable deflector elements 15 which are preferably formed by vanes or rods arranged with parallel axes. The rotor 11 is open at the upper and lower ends.

An annular distributor plate 16 which is rotatable together with the rotor 11 is provided on the upper face of the rotor 11. Two connections **18*a*, 18*b* for the delivery of material to the distributor plate 16 are located in the housing cover 17**.

Above the rotor 11 the separator 9 also contains a tailing hopper 19 the lower opening of which opens above the grinding track **3*a* of the grinding plate 3. The material is delivered to the ring mill 1 via a material delivery opening 20**.

The grinding apparatus also contains a mechanical conveyor 21 and a material divider 22.

The grinding apparatus operates by the grinding method according to the invention as follows:

The material delivered to the grinding plate 3 of the ring mill 1 is comminuted by the action of the grinding rollers 5 and discharged over the outer edge of the grinding track **3*a*. The air speed in the air ring 6 is chosen so that it is so low that not only the tailings but also a proportion of the material already comminuted to the fineness of the finished product falls downwards against the air stream (arrow 23). The rest of the fines (arrows 24) is taken up by the air stream (arrows 8) and elevated pneumatically to the separator 9**.

The material falling downwards in the air ring 6 against the air stream (arrow 23) is elevated by the mechanical conveyor 21 and delivered via the connections **18*a*, 18*b* to the distributor plate 16 (arrows 23*a*). If required (e.g. in the case of grinding various types) the mechanically elevated material can also be passed via the material divider 22 direct to the grinding plate 3 (arrow 23*b***).

The proportion of the mechanically elevated material delivered to the distributor plate 16 via the connections **18*a*, 18*b* is carried radially outwards by the distributor plate, deflected downwards via an annular baffle arranged on the housing cover 17 and then enters the chamber before the guide vane ring 10. Here the material elevated by the mechanical conveyor 21 and distributed by the distributor plate 16 (arrows 23***a*) enters the air stream (arrow 8) which contains the material which has been taken up pneumatically (arrow 24).

Intensive air separation which is supported by the deflector elements 15 on the periphery of the rotor 11 takes place in the separation chamber before and behind the guide vane ring 10. The fines (arrow 25) leave the separator 9 together with the air stream (arrow 8) via a discharge duct 26, whilst the tailings (arrow 27) fall downwards and pass via the tailings hopper 19 back to the grinding plate 3. Fresh material for grinding (arrow 28) is delivered via the material delivery opening 20.

The technical advance achieved by the invention will be explained with the aid of the following test example: In grinding apparatus the air speed in the air ring was reduced from 55 m/s to 40 m/s. Where originally 250 t/h material had been pneumatically elevated, this quantity now drop to 50 t/h, whilst the quantity to be elevated mechanically rose correspondingly. If originally (with an air speed of 55 m/s) all of the mechanically elevated material was delivered directly back to the grinding track, then with the air speed reduced to 40 m/s all of the mechanically elevated material was delivered to the distributor plate. The measures according to the invention produced an energy saving of approximately 20% for the entire apparatus (mill and fan).

I claim:

1. The method of comminuting material comprising:

(a) delivering fresh material to be comminuted to a grinding plate;

(b) grinding the material on said plate;

(c) discharging combined tailings and finished ground product from said plate into an air stream flowing upwardly relative to said plate;

(d) pnuematically conveying a portion of said finished ground product upwardly into a separator by said air stream;

(e) mechanically conveying said tailings and remaining portion of said finished ground material upwardly relative to said plate into said separator;

(f) introducing said tailings and said remaining portion of said finished ground product into said air stream;

(g) discharging an additional portion of said finished ground product by means of said air stream; and (h) reintroducing material including said tailings separated from said air stream onto said grinding plate along with additional fresh material to be comminuted.

2. The method of claim 1 including maintaining the speed of said air stream at such value that the total amount of material mechanically conveyed is greater than the amount pneumatically conveyed.

3. The method of claim 2 wherein the introduction of said tailings and said remaining portion of said finished ground product by said air stream into said separator occurs generally countercurrent to the upward flow of said air stream.

4. The method of claim 3 including introducing said tailings and remaining portion of said finished material into material divider means prior to conveyance into said separator whereby selected portions of said material are removed, and reintroducing said selected portions onto said grinding plate.

5. Apparatus for comminuting material comprising a ring mill having a grinding track, air stream generating means for providing an air stream to elevate finished ground material discharged from said grinding track, a mechanical conveyor in communication with said grinding track for receiving finished ground material including tailings discharged from said grinding track, a separator at a level above that of said ring mill for receiving said air stream and in communication with said mechanical conveyor for receiving said ground material from said mechanical conveyor to separate finished ground material from said tailings, and air stream speed control means assoicated with said air stream generating means for controlling the output of said generating means to effect reduction in the proportion of finished ground material elevated by said air stream to said separator and an increase in the proportion of finished ground material conveyed by said mechanical conveyor.

6. The apparatus of claim 5 wherein material delivery means are associated with said separator for introducing ground material from said mechanical conveyor into said air stream.

7. The apparatus of claim 6 wherein said separator includes a stationary guide vane ring through which said air stream moves, a rotor mounted within said guide vane ring and including material deflector elements on its periphery, distributor plate means on said rotor and rotatable therewith for delivering and distributing material received from said mechanical conveyor, air stream discharge means, and hopper means below said rotor for receiving tailings for subsequent reintroduction thereof onto said grinding track.

8. The apparatus of claim 7 wherein said delivery means includes at least two connections distributed peripherally and symmetrically above said distributor plate means for the delivery of material from said mechanical conveyor.

9. The apparatus of claim 6 including material divider means located in said material delivery means between said mechanical conveyor and said separator whereby selected portions of said material may be removed, and return means for reintroducing said selected portions onto said grinding track.

* * * * *

UNITED STATES PATENT AND TRADEMARK OFFICE

CERTIFICATE OF CORRECTION

PATENT NO. : 4,919,341

DATED : April 24, 1990

INVENTOR(S) : Ludger Lohnherr

It is certified that error appears in the above-identified patent and that said Letters Patent is hereby corrected as shown below:

In column 1, line 40, after "improved" insert -- grinding method --;

In column 1, line 40, after "and" insert -- grinding apparatus --.

Signed and Sealed this Ninth Day of July, 1991

*Attest:*

*Attesting Officer*

HARRY F. MANBECK, JR.

*Commissioner of Patents and Trademarks*